US005280810A

United States Patent [19]

Shimizu

[11] Patent Number: 5,280,810

[45] Date of Patent: Jan. 25, 1994

[54] HEALD FRAME WITH STABILIZER ROD

[75] Inventor: Yoichi Shimizu, Osaka, Japan

[73] Assignee: Nankai Kogyo Kabushiki Kaisha, Osaka, Japan

[21] Appl. No.: 981,500

[22] Filed: Nov. 25, 1992

[30] Foreign Application Priority Data

Jul. 16, 1992 [JP] Japan ..... 4-212116

[51] Int. Cl.[5] ..... D03C 9/06

[52] U.S. Cl. ..... 139/91; 139/92

[58] Field of Search ..... 139/91-92; 248/298

[56] References Cited

U.S. PATENT DOCUMENTS

| | | | |
|---|---|---|---|
| 3,754,577 | 8/1973 | Heller | 139/92 |
| 3,949,789 | 4/1976 | Graf | 139/91 |
| 4,404,994 | 9/1983 | Root et al. | 139/91 |
| 4,681,476 | 7/1987 | Mischenko | 248/298 X |
| 4,913,194 | 4/1990 | Kramer | 139/91 |

FOREIGN PATENT DOCUMENTS

| | | | |
|---|---|---|---|
| 0457210 | 11/1991 | European Pat. Off. | 139/91 |
| 31-37243 | 6/1991 | Japan | 139/91 |

*Primary Examiner*—Andrew M. Falik

*Attorney, Agent, or Firm*—Browdy and Neimark

[57] ABSTRACT

A heald frame comprises frame staves which provide upper and lower frame members and side stays which provide left and right frame members. A stabilizer rod is placed in parallel relationship with the frame staves and fixed to them by plural holders. The holders have plates on the top and bottom sides, and the frame staves and the stabilizer rod are interposed between the plates. The holders have a mount, which is positioned between the frame staves and the stabilizer rods. The mount can be fixed freely at any position on the frame stave. The stabilizer rod is pressed against the mount for fixing.

5 Claims, 2 Drawing Sheets

HEALD FRAME WITH STABILIZER ROD

FIELD OF THE INVENTION

The present invention relates to an improvement of a heald frame for looms. More particularly, it relates to a deformation control device which strengthens the upper and lower frame staves of a heald frame.

BACKGROUND OF THE INVENTION

The principle parts of a heald frame are composed of frame staves which provide its upper and lower frame members and side stays which provide its right and left frame members. A heald frame has two carrier rods, upper and lower, placed along the frame staves, to which multiple healds are attached to support warps. The heald frame is incorporated in a loom to move reciprocally in the vertical direction.

In recent looms, due to the increased operating speed, heald frames move reciprocally in the vertical direction at a very high speed, which causes deformations due to such repetitive movement. In a heald frame, the severest deformation occurs in the frame staves, which are arcuately bent by the repeated flexing during up and down movement. The deformation of frame staves further increases when a loom is operated at a higher speed and/or longer frame staves are used. Such increased deformation causes breakage of healds or cutting of warps.

Conventionally, in order to suppress such deformation, thicker frame staves or laying down center stays at appropriate locations between the upper and lower frame staves have been tried. However, the use of thicker frame staves is not preferable, because it leads to a weight increase, which is not desired for a high-speed loom. The provision of center stays also has disadvantages because the center stays must be positioned in a manner that cuts between the aligned healds. Since thicker and stronger stays cannot be used, the center stays may be accidentally broken when a strong deformative force occurs in the heald frame. In addition, as they must be installed with the heald frame incorporated in a loom and warps in place, the installation is difficult, and users generally hesitate to use them.

SUMMARY OF THE INVENTION

It is an object of the invention to provide a heald frame specifically suitable for use with high-speed looms and elongated frame staves.

It is another object of the invention to provide a heald frame wherein the repetitive flex produced in frame staves and the overall deformation of the heald frame are reduced in vertical reciprocating motions during the loom operation, which results in preventing breakage of healds or cutting of warps.

It is the other object of the invention to provide a heald frame that causes a minimal weight increase in spite of a deformation control means provided therein.

It is a further object of the invention to provide a heald frame that is adjustable to provide the maximum deformation control effect by changing positions of holders of a stabilizer rod before weaving.

It is a still further object of the invention to provide a heald frame wherein plates existing in the top and bottom sides of a holder serve as slide guide plates between the heads frames, when multiple heald frames are aligned and installed in a loom, thereby allowing them to move smoothly in the vertical direction.

It is an even further object of the invention to provide a heald frame wherein a stabilizer rod is bent and fixed, and prestressed to have a higher deformation strength in order to further increase the deformation controlling property of the heald frame.

Other features and benefits of the invention will become apparent from the following description with reference to the accompanying drawings.

DETAILED DESCRIPTION OF THE PREFERRED EMBODIMENTS

Figure 1:
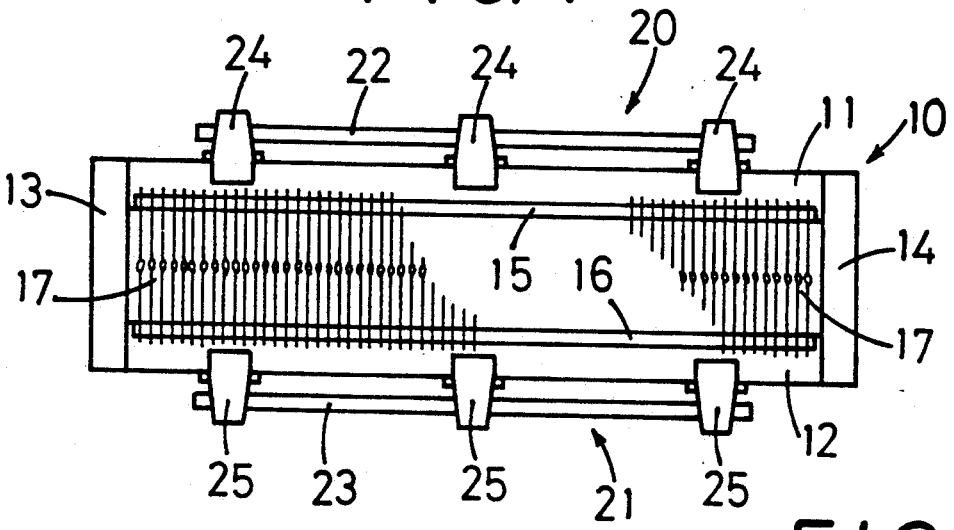
FIG. 1 is a front view showing one of the embodiments of a heald frame of the invention with healds placed therein.

FIG. 1 shows one of the embodiments of a heald frame of the invention. The principal parts of a heald frame 10 are composed of frame staves 11 and 12 which provide upper and lower frame members and side stays 13 and 14 which provide left and right frame members. The frame staves 11 and 12 and the side stays 13 and 14 are joined at their ends to form a rectangular framework. The frame staves 11 and 12 are respectively provided with carrier rods 15 and 16, and multiple healds 17 lie between the upper and lower carrier rods 15 and 16. The mounting method of the carrier rods 15 and 16 on the frame staves 11 and 12 is not limited, and the one shown in the embodiment is known as the riderless method, which uses rivets for direct fixing. Other methods such as supporting the carrier rods by hangers may also be employed.

Stabilizers 20 and 21 are provided on the frame staves 11 and 12. It is also possible to provide the stabilizer only in either one of the upper or lower frame staves 11 and 12. Stabilizer rods 22 and 23 are placed approximately parallel to the frame staves 11 and 12 and fixed to them at plural appropriate points by holders 24 and 25. A light and rigid material is preferably used for the stabilizer rods 22 and 23, such suitable materials including, for example, carbon fiber reinforced plastics, glass reinforced plastics, GFRP, aluminium alloys and light and rigid composite materials. While the number of holders 24 and 25 used in the embodiment is three, an appropriate number is preferably determined according to the specific condition of use, and two to six holders are suitable in general.

Figure 2:
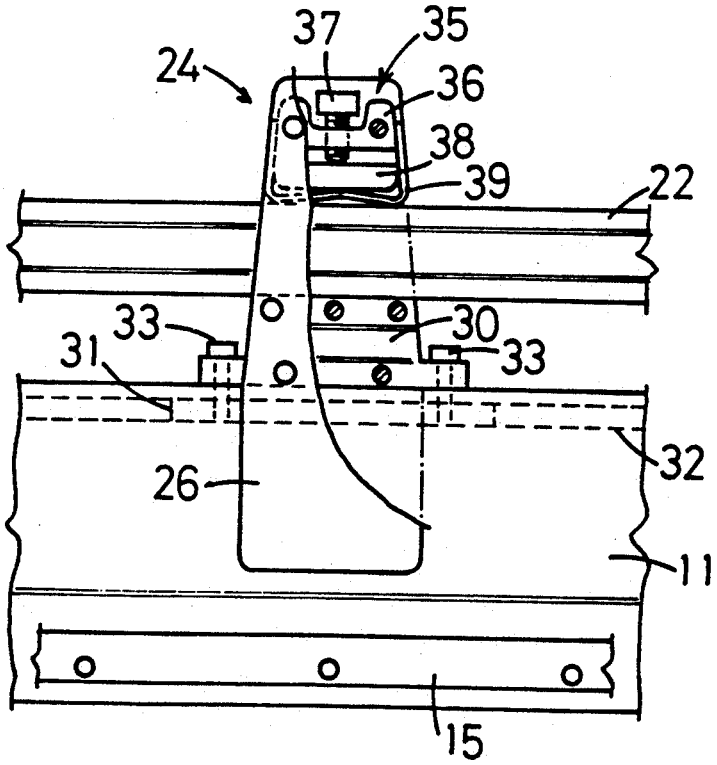
FIG. 2 is a magnified view of a holder part with a plate partly cut away.
Figure 3:
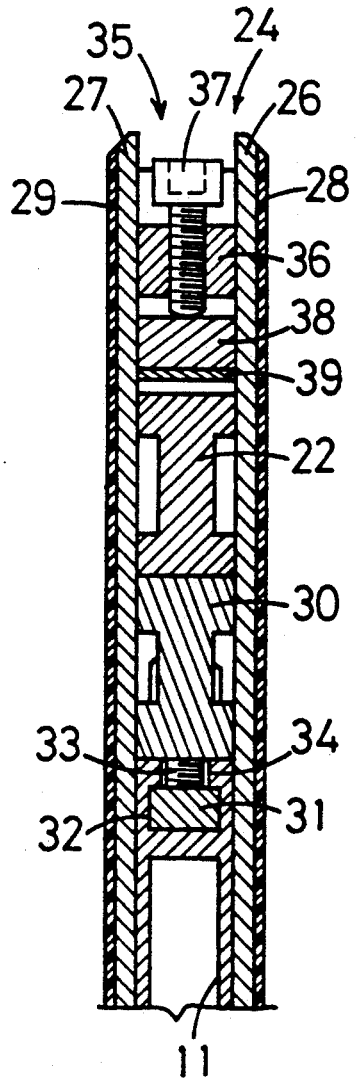
FIG. 3 is a magnified sectional view of the holder shown in FIG. 2 in an assembled state.
Figure 4:
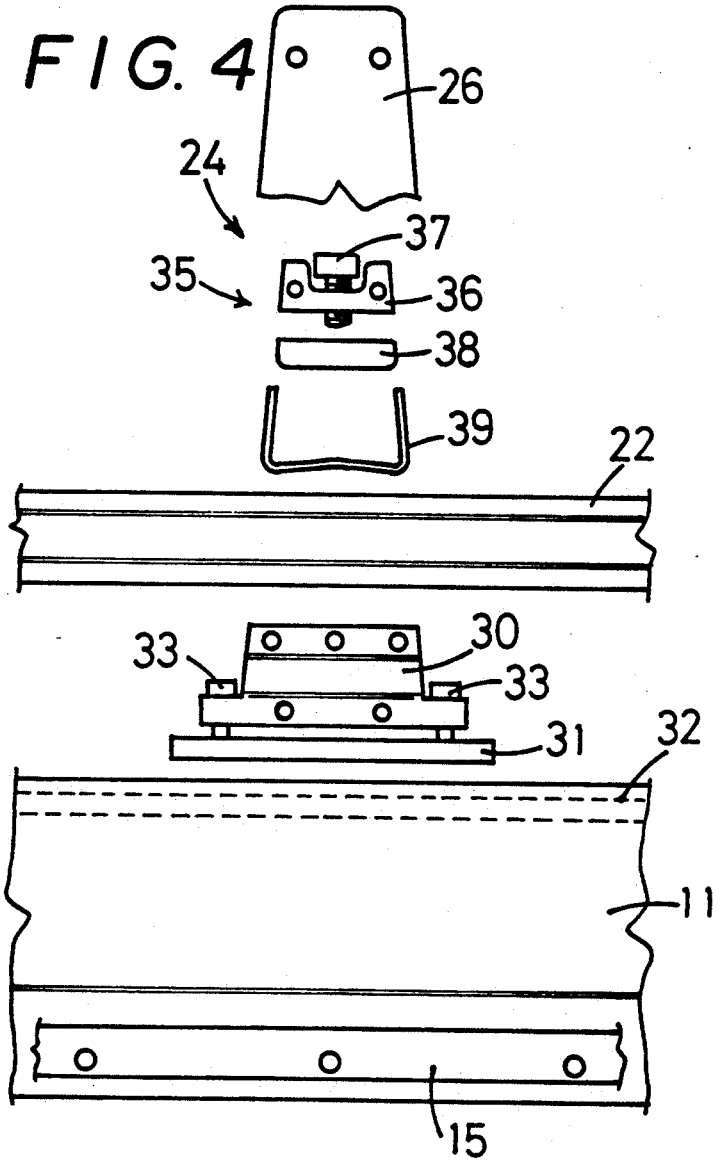
FIG. 4 is an exploded view of the holder shown in FIG. 2.

FIGS. 2, 3 and 4 shown the detailed structure of the holder 24. The frame stave 11 and the stabilizer rod 22 are interposed between two plates 26 and 27 may be formed integrally to have both top and bottom sides by bending over at the upper end. The plates 26 and 27 serve also as slide guide plates when plural heald frames 10 are adjacently installed in a loom. Therefor, sheets 28 and 29 having a superior slidability are affixed to the outer surfaces thereof. It is also possible to provide the sheet only on one of the plates on the top or bottom side.

Any material may be used for the sheets 28 and 29, as long as it provides a low friction coefficient, so that when the sheets are in contact with each other they can easily slide against each other. The top and bottom sheets 28 and 29 may be of a same material or different materials. Generally, a preferable combination is a metallic material for one and a plastic material for the other. For example, one sheet is composed of a fluoroplastic or a plastic containing a lubricant such as molybdenum, while the other surface may be hard-plated or treated with hard alumite instead of adhering a sheet material.

A mount 30 is placed between the top and bottom plates 26 and 27 and affixed to the plates by using rivets, screws or an adhesive. When the holder 24 is set onto the frame stave 11, the mount 30 comes in contact with the upper edge of the frame stave 11. A long nut 31 is inserted in a groove 32 formed in the frame stave 11. The nut 31 freely slides within the groove 32. The mount 30 and the nut 31 are combined by a bolt 33. In the upper surface of the groove 32, there is an opening 34 which is narrower than the groove width. This prevents the nut 31 from escaping out in the upward direction, while allowing the bolt 33 to pass through the opening 34. Thus, by tightening the bolt 33, the mount 30 can be fixed to the frame stave 11. In the loosened state of the bolt 32, meanwhile, the mount 30 and the nut 11 are freely slidable in the longitudinal direction. The holder 24, therefore, can be set at a desired position on the frame stave 11.

The stabilizer rod 22 is in contact with the upper surface of the mount 30. In other words, the mount 30 is interposed between the frame stave 11 and the rod 22. In this way, the gap between the frame stave 11 and the rod 22 is controlled at a specific size. The rod 22, however, is slidably engaged between the plates 26 and 27 and is not fixed therebetween.

The holder 24 has a presser mechanism 35 on the top. The presser mechanism 35 applies a compressive force to the stabilizer rod 22 to pressure-bond the rod 22 to the mount 30. In this embodiment, the presser mechanism 35 comprises a bolt supporting member 36, a bolt 37, a presser plate 38 and a plate spring 39. The bolt supporting member 36 is affixed to the top and bottom plates 26 and 27. Since the bolt 37 is engaged with the supporting member 36, it moves in the axial direction as the bolt 37 rotates. The presser member 38, which is freely movable, is pressed by the bolt 37 to come in contact with the plate spring 39. Thus, by tightening the bolt 37, a compressive force is applied by way of the presser member 38 and the plate spring 39 to the upper surface of the stabilizer rod 22.

The holder 24 having such structure as described above is handled as follows. With the bolts 33 and 37 loosened, the holder 24 is freely slidable right and left along the frame stave 11. The position of holder 24 must be determined carefully, since it greatly affects the deformation control of the heald frame 10. The optimal positioning of the holder 24 is unknown in the designing stage and is identified only when the loom is actually operated. Every heald frame or loom has a different natural frequency, depending on structural differences, and the repetitive deformation of the heald frame which is generated during its operation is theoretically unpredictable, since it varies depending on the natural frequency. The only way for users to find the holder positions for the optimum deformation control, therefor, is to perform a test weaving run for each cloth design to be woven before starting a regular weaving operation. Generally, the optimal positioning of holders is not symmetrical but often asymmetrical in relation to the frame staves.

The holders 24 are thus positioned, then the bolt 33 is tightened. As the bolt 33 is engaged with the nut 31 in the groove 32 of the frame stave 11, the mount 30 is fixed to the frame stave 11 by tightening the bolt 33. Since the mount 30 and the plates 26 and 27 are integrally formed, the plates 26 and 27 are also fixed as the mount 30 is fixed. Then, by tightening the bolt 37, a compressive force is applied by way of the presser member 38 and the plate spring 39 to the stabilizer rod 22 to pressure-bond and fix the rod 22 to the mount 30.

When the assembly is thus completed as described, the stabilizer rod 22 is placed and fixed in parallel relationship with the frame stave 11. Thus, the stabilizer 22 acts so as to control the deformation in the frame stave 11 to prevent it from deflecting and deforming during the reciprocating motion.

Figure 6:
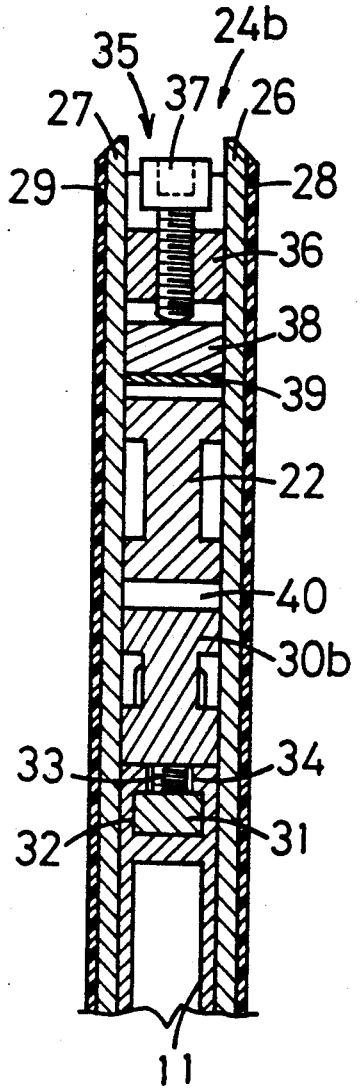
FIG. 6 is a magnified sectional view of the holder in FIG. 5 in an assembled state.
Figure 5:
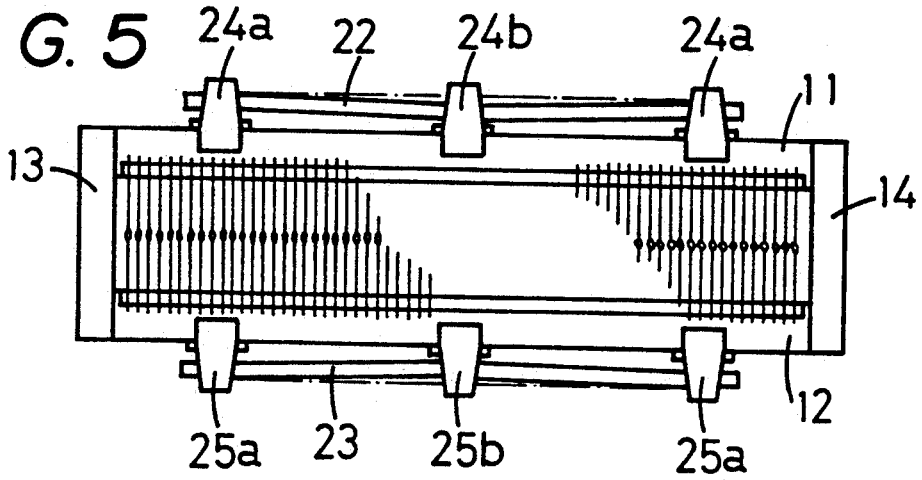
FIG. 5 is a front view of another embodiment of the invention.

FIGS. 5 and 6 illustrate another embodiment which utilizes prestressing method. Three or more holders 24 must be employed. The holders **24*a* and 25*a* located at both ends and holders 24*b* and 25*b* in the middle position have different heights of their mounts. In other words, the mount 30*b* of the intermediate holder 24*b* is shorter than those at the ends. As shown in FIG. 6, this results in creating a gap 40 between the stabilizer rod 22 and the mount 30*b* when the bolt 37** is not tightened.

When the bolt **37*b* is tightened, the rod 22 is subject to the compressive force and flexes by the gap 40. This allows the rod 22 to be fixed in a curve-deformed state, that is, fixed in a stressed state. In this embodiment, as the stabilizer rod 22 is prestressed, the rod 22** gains a higher bending strength to more effectively control the deformation on the frame stave.

The description hereinabove is made only for the embodiments of the present invention, and it is to be understood that the invention is not limited to the embodiment and various changes and modifications may be made in the invention within its true spirit and scope as set forth in the accompanying claims.

What is claimed is:

1. A deformation control device for a heald frame for looms, said control device comprising:

a heald frame having a rectangular framework for upper and lower frame staves and left and right side stays, a stabilizer rod fixed in a parallel relationship to at least one of said frame staves on an outside side thereof on a perimeter of said heald frame, a plurality of holder means slidably engaged between said stabilizer rod and said at least one of said frame staves in at least two points on said at least one of said frame staves for fastening said stabilizer rod to said sat least one of said frame staves in spaced relationship from said heald frame, the longitudinal axis of each of said holder means being perpendicular to the longitudinal axis of said at least one of said frame staves wherein each holder means of said plurality of holder means has a first fixing means for slidably engaging and locking to said at least one of said frame staves and a second fixing means for slidably engaging and locking to said stabilizer, whereby said each holder means is slidable on said stabilizer rod and said outside surface of at least one of said frame staves.

2. The device according to claim 1, wherein the plurality of said holder means are engaged between said stabilizer rod and said at least one of said frame staves to fix said stabilizer rod in a curved state.

3. The device according to claim 1, where said each said holder means have plates on a first side and a second side, said at least one of said staves and said stabilizer rod being interposed between said plates, and a surface of said plates being made of a material having a low coefficient of friction.

4. The device according to claim 1, wherein said each holder means has a mount interposed between said at least one of said frame staves and said stabilizer rod, said mount being bolted to a nut placed within a groove in said at least one of said frame staves, and said each said holder means further having a presser means for creating a pressure bond between said stabilizer rod and said mount.

5. The device according to claim 4, wherein more than two holder means are used to engage a stabilizer rod, and a height of a mount of a holder means of said more than two holder means located between remaining holder means of said more than two holder means is shorter than mounts of said remaining holder means so that said stabilizer rod is curved when said stabilizer rod is pressure bonded to each said mount of said more than two holder means by said presser means of said more than two holder means.

* * * * *